US011252795B2

(12) United States Patent
Jurik et al.

(10) Patent No.: US 11,252,795 B2
(45) Date of Patent: Feb. 15, 2022

(54) REMOVABLE LED MODULE

(71) Applicant: Robe Lighting s.r.o., Roznov pod Radhostem (CZ)

(72) Inventors: Pavel Jurik, Prostredni Becva (CZ); Tomas David, Podoli (CZ); Jindrich Vavrik, Zubri (CZ); Jan Vilem, Vsetin (CZ); Josef Valchar, Prostredni Becva (CZ)

(73) Assignee: Robe Lighting s.r.o.

( * ) Notice: Subject to any disclaimer, the term of this patent is extended or adjusted under 35 U.S.C. 154(b) by 0 days.

(21) Appl. No.: 17/232,464

(22) Filed: Apr. 16, 2021

(65) Prior Publication Data

US 2021/0235557 A1 Jul. 29, 2021

Related U.S. Application Data

(63) Continuation of application No. 16/839,707, filed on Apr. 3, 2020, now Pat. No. 11,013,079.
(Continued)

(51) Int. Cl.
*H05B 45/12* (2020.01)
*H05B 47/19* (2020.01)
(Continued)

(52) U.S. Cl.
CPC ..... *H05B 45/12* (2020.01); *F21V 5/007* (2013.01); *F21V 19/0055* (2013.01);
(Continued)

(58) Field of Classification Search
CPC .... F21V 19/003; F21V 19/0035; F21V 19/04; F21V 19/042; F21V 19/045;
(Continued)

(56) References Cited

U.S. PATENT DOCUMENTS 6,843,586 B1 1/2005 Allaire
7,810,968 B1 10/2010 Walker et al.
(Continued)

FOREIGN PATENT DOCUMENTS

CN 112555782 A 3/2021
EP 3799532 A1 3/2021
(Continued)

OTHER PUBLICATIONS

Office Action dated May 26, 2020; U.S. Appl. No. 16/839,707, filed Apr. 3, 2020; 19 pages.
(Continued)

*Primary Examiner* — Jason Crawford
(74) *Attorney, Agent, or Firm* — Conley Rose, P.C.; Brooks W Taylor

(57) ABSTRACT

A method is provided for removing a light-emitting diode (LED) module from a luminaire that has a controller and a housing. The housing encloses an optical system that includes the LED module and other optical devices. The method includes electrically uncoupling an LED circuit board of the LED module from the controller. The method further includes mechanically uncoupling the LED module from the luminaire without removing other optical devices of the optical system from the housing.

17 Claims, 13 Drawing Sheets

Related U.S. Application Data

(60) Provisional application No. 62/896,739, filed on Sep. 6, 2019.

(51) Int. Cl.

| | |
|---|---|
| ***F21V 19/00*** | (2006.01) |
| ***F21V 19/04*** | (2006.01) |
| ***F21V 23/06*** | (2006.01) |
| ***H05B 47/28*** | (2020.01) |
| ***F21V 29/70*** | (2015.01) |
| ***F21V 5/00*** | (2018.01) |
| ***F21V 29/51*** | (2015.01) |
| ***F21V 23/04*** | (2006.01) |
| *F21Y 105/18* | (2016.01) |
| *F21Y 115/10* | (2016.01) |

(52) U.S. Cl.

CPC ..... *F21V 19/04* (2013.01); *F21V 23/0435* (2013.01); *F21V 23/0457* (2013.01); *F21V 23/06* (2013.01); *F21V 29/51* (2015.01); *F21V 29/70* (2015.01); *H05B 47/19* (2020.01); *H05B 47/28* (2020.01); *F21Y 2105/18* (2016.08); *F21Y 2115/10* (2016.08)

(58) Field of Classification Search

CPC ..... F21V 19/0055; F21V 29/50–51; F21V 29/70–71; F21V 17/002; H05B 45/10; H05B 45/12; H05B 47/19; H05B 47/28; F21S 2/005

See application file for complete search history.

(56) References Cited

U.S. PATENT DOCUMENTS

| | | | | |
|---|---|---|---|---|
| 8,002,446 | B1 | 8/2011 | Plunk et al. | |
| 8,678,605 | B2 | 3/2014 | Leadford | |
| 8,926,145 | B2 | 1/2015 | Lynch et al. | |
| 9,408,282 | B1 | 8/2016 | Springer | |
| 9,548,797 | B1 * | 1/2017 | Green | H05B 47/19 |
| 9,726,337 | B2 | 8/2017 | Hedberg, Jr. | |
| 9,974,147 | B1 | 5/2018 | Davis et al. | |
| 10,125,946 | B2 | 11/2018 | Meerbeek et al. | |
| 10,378,733 | B1 * | 8/2019 | McLellan | F21S 41/143 |
| 10,801,678 | B1 * | 10/2020 | McLellan | F21K 9/20 |
| 2004/0095771 | A1 | 5/2004 | McDonald | |
| 2009/0196016 | A1 | 8/2009 | Massara et al. | |
| 2010/0014289 | A1 | 1/2010 | Thomas et al. | |
| 2011/0194282 | A1 | 4/2011 | Paik et al. | |
| 2012/0033429 | A1 * | 2/2012 | Van De Ven | H05B 45/30 362/294 |
| 2012/0051065 | A1 | 3/2012 | Daily et al. | |
| 2012/0119661 | A1 | 5/2012 | Muller | |
| 2012/0155080 | A1 | 6/2012 | Schupple et al. | |
| 2013/0278163 | A1 | 10/2013 | Rodriguez et al. | |
| 2013/0293112 | A1 | 11/2013 | Reed et al. | |
| 2013/0294085 | A1 | 11/2013 | Watanabe et al. | |
| 2014/0119031 | A1 | 5/2014 | Van Gompel et al. | |
| 2015/0009677 | A1 | 1/2015 | Catalano | |
| 2015/0167937 | A1 | 6/2015 | Casper et al. | |
| 2015/0198324 | A1 | 7/2015 | OBrien et al. | |
| 2015/0338077 | A1 | 11/2015 | Johnson | |
| 2016/0123541 | A1 | 5/2016 | Quilici et al. | |
| 2016/0165702 | A1 * | 6/2016 | Lai | H05B 45/10 315/201 |
| 2016/0273741 | A1 | 9/2016 | Jung | |
| 2017/0094756 | A1 | 3/2017 | Saffari | |
| 2017/0171949 | A1 * | 6/2017 | Kim | F21K 9/238 |
| 2017/0184289 | A1 | 6/2017 | Nolan et al. | |
| 2017/0238397 | A1 * | 8/2017 | Green | H05B 47/29 315/129 |
| 2018/0042092 | A1 * | 2/2018 | Bowser | H05B 47/18 |
| 2018/0160511 | A1 | 6/2018 | Haverlag et al. | |
| 2018/0343403 | A1 | 11/2018 | Mehdi et al. | |
| 2019/0195479 | A1 * | 6/2019 | Bonne | F21V 29/50 |
| 2019/0219249 | A1 | 7/2019 | David et al. | |
| 2020/0232625 | A1 | 7/2020 | Jurik et al. | |
| 2020/0232626 | A1 | 7/2020 | Jurik et al. | |
| 2020/0236759 | A1 | 7/2020 | Jurik et al. | |
| 2020/0393119 | A1 * | 12/2020 | Portinga | F21V 7/0091 |

FOREIGN PATENT DOCUMENTS

| | | | |
|---|---|---|---|
| EP | 3800393 | A1 | 4/2021 |
| EP | 3800394 | A1 | 4/2021 |
| WO | 2016173832 | A1 | 11/2016 |

OTHER PUBLICATIONS

Final Office Action dated Aug. 20, 2020; U.S. Appl. No. 16/839,707, filed Apr. 3, 2020; 24 pages.

Advisory Action dated Oct. 27, 2020; U.S. Appl. No. 16/839,707, filed Apr. 3, 2020; 3 pages.

Notice of Allowance dated Dec. 31, 2020; U.S. Appl. No. 16/839,707, filed Apr. 3, 2020; 17 pages.

Office Action dated Jun. 15, 2020; U.S. Appl. No. 16/839,711, filed Apr. 3, 2020; 16 pages.

Final Office Action dated Oct. 30, 2020; U.S. Appl. No. 16/839,711, filed Apr. 3, 2020; 21 pages.

Notice of Allowance dated Feb. 24, 2021; U.S. Appl. No. 16/839,711, filed Apr. 3, 2020; 12 pages.

Office Action dated Jun. 2, 2020; U.S. Appl. No. 16/839,735, filed Apr. 3, 2020; 14 pages.

Final Office Action dated Oct. 1, 2020; U.S. Appl. No. 16/839,735, filed Apr. 3, 2020; 21 pages.

Notice of Allowance dated Feb. 1, 2021; U.S. Appl. No. 16/839,735, filed Apr. 3, 2020; 12 pages.

European Extended Search Report dated Feb. 24, 2021; Application No. 20192235.8; filed Aug. 21, 2020; 7 pages.

European Extended Search Report dated Feb. 3, 2021; Application No. 20194726.4; filed Sep. 4, 2020; 6 pages.

European Extended Search Report dated Feb. 9, 2021; Application No. 20194740.5; filed Sep. 4, 2020; 6 pages.

Robe; "Robe Launches New Esprite LED Moving Light"; https://www.robe.cz/news/robe-launches-new-esprite-led-moving-light; Sep. 4, 2019; 2 pages.

European Examination Report; Application No. 20192235.8; dated Dec. 14, 2021; 7 pages.

European Examination Report; Application No. 20194726.4; dated Dec. 16, 2021; 5 pages.

European Examination Report; Application No. 20194740.5; dated Dec. 16, 2021; 5 pages.

* cited by examiner

REMOVABLE LED MODULE

CROSS-REFERENCE TO RELATED APPLICATIONS

This application is a continuation of U.S. patent application Ser. No. 16/839,707 filed on Apr. 3, 2020 by Pavel Jurik, et al. and entitled, "Removable LED Module," which claims priority to U.S. Provisional Application No. 62/896,739 filed on Sep. 6, 2019 by Pavel Jurik, et al. entitled, "LED Light Engine", both of which are incorporated herein by reference in their entirety for all purposes.

TECHNICAL FIELD OF THE DISCLOSURE

The disclosure generally relates to automated luminaires, and more specifically to a removable light-emitting diode (LED) module for use in an automated luminaire.

BACKGROUND

Luminaires with automated and remotely controllable functionality (also referred to as automated luminaires) are well known in the entertainment and architectural lighting markets. Such products are commonly used in theatres, television studios, concerts, theme parks, night clubs, and other venues. A typical product will commonly provide control over the pan and tilt functions of the luminaire allowing the operator to control the direction the luminaire is pointing and thus the position of the light beam on the stage or in the studio. Typically, this position control is done via control of the luminaire's orientation in two orthogonal rotational axes usually referred to as pan and tilt. Many products provide control over other parameters such as the intensity, focus, beam size, beam shape, and beam pattern. In particular, control is often provided for the color of the output beam which may be provided by controlling the insertion of dichroic colored filters across the light beam.

SUMMARY

In a first embodiment, a method for removing a light-emitting diode (LED) module from a luminaire comprising a housing enclosing an optical system that includes the LED module and other optical devices includes electrically uncoupling an LED circuit board of the LED module from the luminaire. The method further includes mechanically uncoupling the LED module from the luminaire without removing other optical devices of the optical system from the housing.

In a second embodiment, a method for removing a light-emitting diode (LED) module from a luminaire comprising a controller and housing enclosing an optical system that includes the LED module and other optical devices includes electrically uncoupling an LED circuit board of the LED module from the controller. The method further includes mechanically uncoupling the LED module from the luminaire without removing other optical devices of the optical system from the housing.

BRIEF DESCRIPTION OF THE DRAWINGS

For a more complete understanding of this disclosure, reference is now made to the following brief description, taken in conjunction with the accompanying drawings in which like reference numerals indicate like features.

DETAILED DESCRIPTION

Preferred embodiments are illustrated in the figures, like numerals being used to refer to like and corresponding parts of the various drawings.

Figure 1:
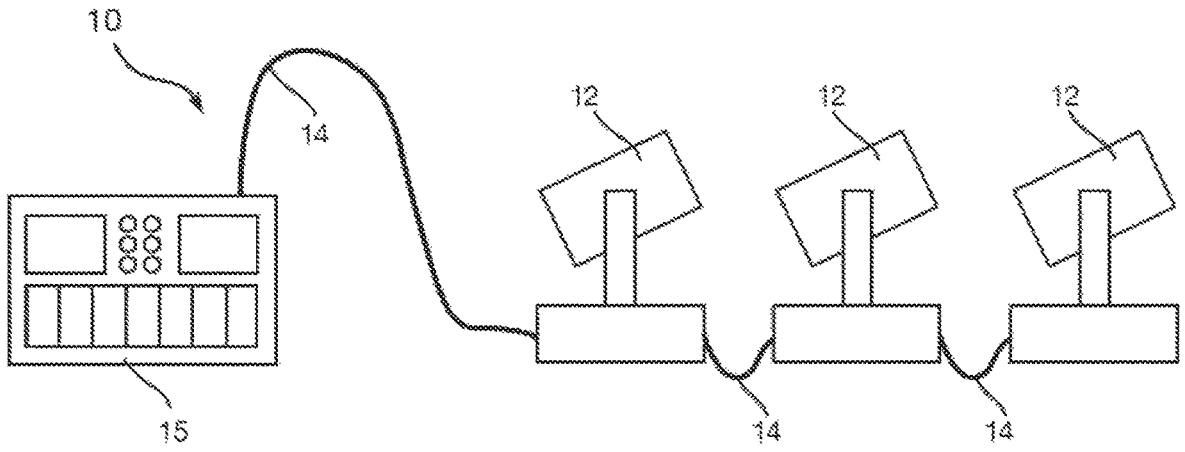
FIG. 1 presents a schematic view of a multiparameter automated luminaire system according to the disclosure.

FIG. 1 presents a schematic view of a multiparameter automated luminaire system 10 according to the disclosure. The multiparameter automated luminaire system 10 includes a plurality of luminaires 12 according to the disclosure. The luminaires 12 each contains on-board a light source, color changing devices, light modulation devices, pan and/or tilt systems to control an orientation of a head of the luminaire 12. Mechanical drive systems to control parameters of the luminaire 12 include motors or other suitable actuators coupled to control electronics, as described in more detail with reference to FIG. 2.

In addition to being connected to an external power source either directly or through a power distribution system, each luminaire 12 is connected in series or in parallel by a data link 14 to one or more control desks 15. Upon actuation by an operator, the control desk 15 may send control signals via the data link 14, where the control signals are received by one or more of the luminaires 12. The one or more of the luminaires 12 that receive the control signals may respond by changing one or more of the parameters of the receiving luminaires 12. The control signals may be sent by the control desk 15 to the luminaires 12 using DMX-512, Art-Net, ACN (Architecture for Control Networks), Streaming ACN, or other suitable communication protocol.

The luminaires 12 may include stepper motors to provide the movement for internal optical systems. Examples of such optical systems may include gobo wheels, effects wheels, and color mixing systems, as well as prism, iris, shutter, and lens movement.

While the multiparameter automated luminaire system 10 comprises moving yoke luminaires 12, the disclosure is not so limited. In other embodiments automated luminaires according to the disclosure may be moving mirror automated luminaires or static automated luminaires.

In some embodiments, luminaires 12 include an LED-based light source and associated optical system. Such an LED light source may contain LEDs that emit light of a common color, such as white, or may contain LEDs that emit light of different colors. Such subsets of LEDs of different colors may be controllable individually so as to provide additive color mixing of the LED outputs.

Some automated luminaires include an LED light source that is physically integrated with the associated optical systems in a manner that makes it difficult for a technician to maintain and replace the LEDs independently from the rest of the optical system. In such automated luminaires it can be difficult to compare the degradation in light output of the LED light source in two or more automated luminaires. Luminaires 12 according to the disclosure provide easier removal of LED modules and associated LED circuit boards, as well as a system for measurement and non-volatile storage of the light output produced by LED emitters of the LED module. LED emitters may also be referred to simply as LEDs.

Figure 2:
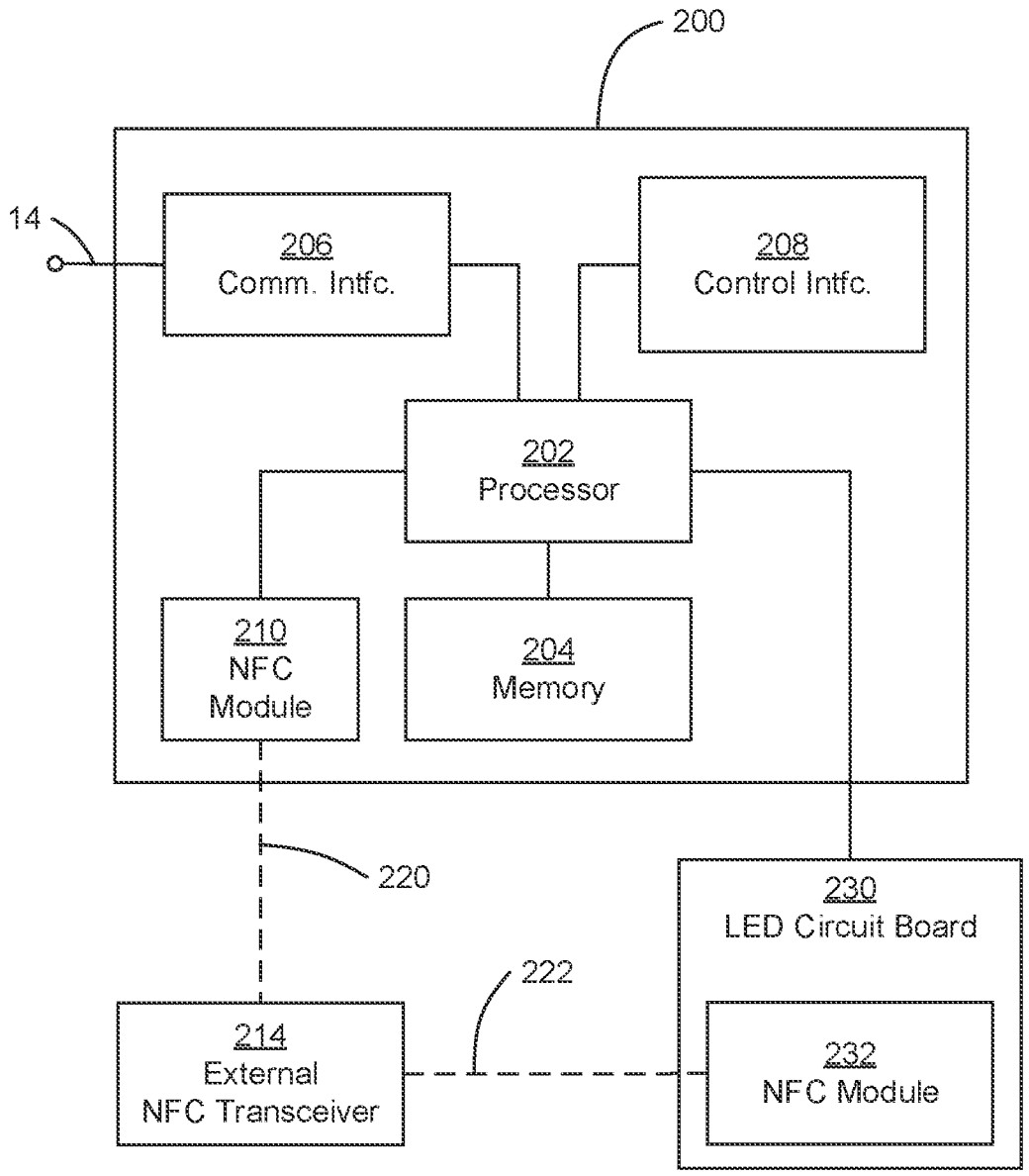
FIG. 2 presents a block diagram of a control system for a luminaire according to the disclosure.

FIG. 2 presents a block diagram of a control system 200 for a luminaire 12 according to the disclosure. The control system (or controller) 200 is suitable for use with an LED module according to the disclosure. The control system 200 is also suitable for controlling other control functions of the automated luminaire system 10. In some embodiments, the control system 200 is powered by an external power source (not shown in FIG. 2).

The control system 200 includes a processor 202 that is electrically coupled to a memory 204. The processor 202 is implemented by hardware and software. The processor 202 may be implemented as one or more Central Processing Unit (CPU) chips, cores (e.g., as a multi-core processor), field-programmable gate arrays (FPGAs), application specific integrated circuits (ASICs), and digital signal processors (DSPs).

The processor 202 is further electrically coupled to and in communication with a communication interface 206. The communication interface 206 is coupled to, and configured to communicate via, at least the data link 14. The processor 202 is also coupled via a control interface 208 to one or more sensors, motors, actuators, controls and/or other devices. In some embodiments these devices include a light level sensor. The processor 202 is configured to receive control signals from the data link 14 via the communication interface 206 and, in response, to control mechanisms of the luminaire 12 via the control interface 208.

In some embodiments, the processor is also coupled to a Near Field Communication (NFC) module 210. Use of the NFC module 210 is further described below with reference to FIG. 5.

The processor 202 is further electrically coupled to and in communication with an LED circuit board 230. The LED circuit board 230 may contain a processor and memory as described with reference to the control system 200. The LED circuit board 230, in some embodiments, further includes an NFC module 232. In various embodiments, the processor 202 may directly control functionality of the LED circuit board 230 (such as individual or group LED brightness), may request from a processor of the LED circuit board 230 information stored in the memory of the processor (such as light measurement data), and may request that the processor in the LED circuit board 230 store information provided by the processor 202 (such as light measurement data resulting from performance of the light measurement process 500 described with reference to FIG. 5).

The control system 200 is suitable for implementing processes, module control, optical device control, pan and tilt movement, parameter control, LED brightness control, and other functionality as disclosed herein, which may be implemented as instructions stored in the memory 204 and executed by the processor 202. The memory 204 comprises one or more disks and/or solid-state drives and may be used to store instructions and data that are read and written during program execution. The memory 204 may be volatile and/or non-volatile and may be read-only memory (ROM), random access memory (RAM), ternary content-addressable memory (TCAM), and/or static random-access memory (SRAM). Similarly, the LED circuit board 230 may contain a processor and memory which includes at least writable non-volatile memory, such as flash memory, which retains its contents when power is removed.

Figure 3:
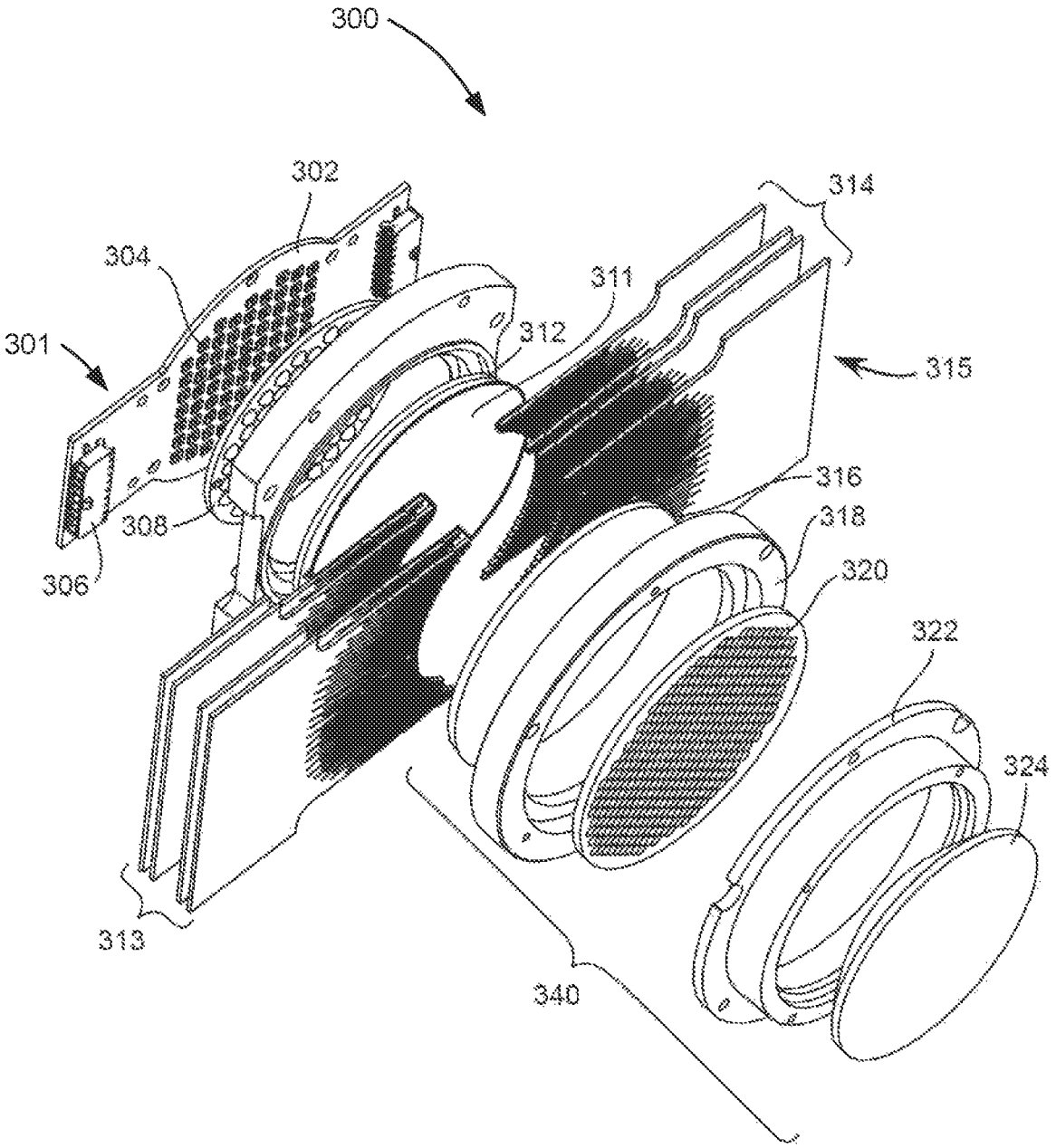
FIG. 3 presents an exploded orthogonal view of an LED optical system according to the disclosure.

FIG. 3 presents an exploded orthogonal view of an LED optical system (or light engine) 300 according to the disclosure. An LED circuit board 301 includes a plurality of LEDs (or LED dies) 304 arranged in an array and mounted on a planar substrate 302. The LED circuit board 301 further includes an electrical connector 306 through which the LEDs 304 can be powered. The LED circuit board 301 still further includes electronic circuitry (not shown in FIG. 3) coupled to the electrical connector 306 for power and communication.

The LEDs 304 all emit white light. In other embodiments, the LEDs 304 emit light in a plurality of colors. In either embodiment, the LEDs 304 may be configured to be controlled as a single group, in multiple groups, or individually, depending on the requirements of the luminaire. Each LED 304 is associated with a primary optic, which may comprise a reflector, total internal reflection (TIR) lens, and/or other suitable optical devices for protecting the LED and controlling distribution of its emitted light. Each LED 304 is further associated with a corresponding pair of collimating lenslets on lens arrays (collimating optics) 308 and 312. In some embodiments, the pair of collimating lenslets associated with each LED may be part of the LED's primary optic, that is, they may be fabricated as part of the LED die, may be separately fabricated and attached to the LED die, or may be in the form of a lens array mounted to one or more of the LED dies or (directly or indirectly) to the planar substrate 302. In other embodiments, such primary optics are part of an LED module according to the disclosure, such as LED module 700, described with reference to FIGS. 7 and 8.

In some embodiments, the LEDs 304 are simple LEDs. In other embodiments, the LEDs 304 comprise an LED emitter coupled with a phosphor. In still other embodiments, the LEDs 304 comprise LED laser diodes with or without an associated phosphor.

In the embodiment shown in FIG. 3, all LEDs 304 emit white light, however other embodiments may include differently colored LEDs 304.

Although the lens arrays 308 and 312 are constructed on two separate substrates, in other embodiments, the lens arrays 308 and 312 may be fabricated on opposite sides of a single (common) substrate. In some embodiments, the lens arrays 308 and 312 and their substrate(s) are simple lens arrays molded from a material comprising glass or a transparent polymer. In other embodiments, the lens arrays 308 and 312 may be fabricated from multiple individual collimating lenslets. In yet other embodiments, the lens arrays 308 and 312 may be replaced with an array of TIR collimators, a fresnel lens, or a single lens array that is fabricated from glass or other optical material having a higher refractive index than lens arrays 308 and 312 or that comprises collimating lenslets having an aspherical profile.

In some embodiments, the lens arrays 308 and 312 may be supplemented by an optical diffuser 311. In some such embodiments, the optical diffuser 311 may be added to lens arrays 308 and 312 as shown in FIG. 3. The optical diffuser 311 may comprise a single diffuser element or multiple diffuser elements.

In either embodiment, the optical diffuser 311 is configured to further mix the light output from LEDs 304 without adding any optical aberrations. The optical diffuser 311 may comprise a transparent or translucent substrate with irregular patterning, body features, or surface features designed to introduce Lambertian, or approximate Lambertian, scattering to the light passing through the optical diffuser 311. Such a diffuser can be created by using a ground substrate, a diffusing substrate, or a holographic etched substrate, as well as by other techniques.

The collimated and substantially parallel light beams emitted by the collimating lens array 312 pass through dichroic filters 313 and 314, which comprise a color mixing module 315. After passing through dichroic filters 313 and 314, the combined light beam produced by all the light beams emitted by the collimating lens array 312, passes through fly-eye lens arrays 316 and 320. The fly-eye lens arrays 316 and 320 may be referred to as homogenizing or integration lens arrays. Each of the fly-eye lens arrays 316 and 320 comprises a plurality of converging lenslets. Fly-eye lens array 316, fly-eye lens array 320, and a converging lens 324 are mounted to mounting plates 318 and 322 to form a unitary integration module 340.

In other embodiments, the fly-eye lens arrays 316 and 320 may be replaced by one or more optical diffusers without lenses. In such embodiments, the one or more optical diffusers and the converging lens 324 may be mounted to mounting plates 318 and 322 to form a unitary integration module 340.

In a further embodiment, the fly-eye lens arrays 316 and 320 may be removable from the path of the light beams either manually or through a motor and mechanism that may be controlled by the user via the data link 14 and the controller 200. For example, the fly-eye lens arrays 316 and 320 may be mounted on a pivoting arm that is coupled to a motor and mechanism so that the fly-eye lens arrays 316 and 320 can be controllably swung out of or into the path of the light beam from the LEDs 304. When the fly-eye lens arrays 316 and 320 are removed from the path of the light beams, the combined light output from the LEDs will no longer be fully homogenized, but may be higher in intensity and may also be useful as a lighting effect.

Figure 4:
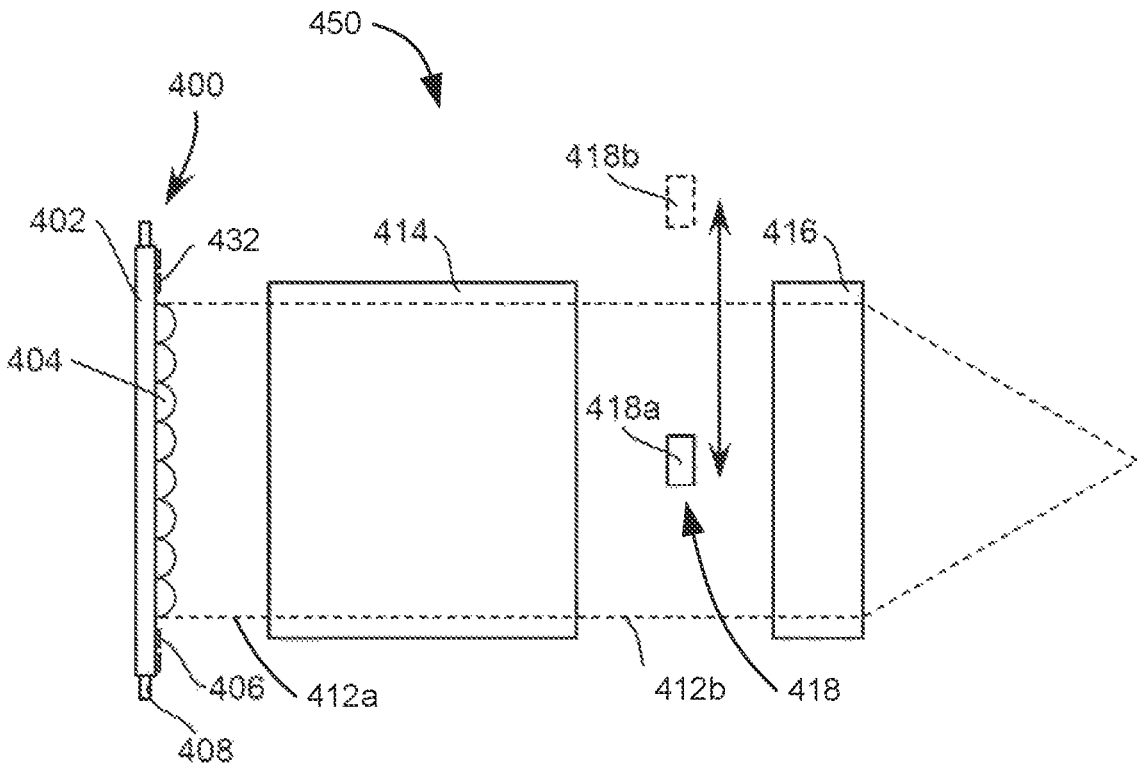
FIG. 4 presents a schematic diagram of an optical system according to the disclosure.

FIG. 4 presents a schematic diagram of a light engine 450 according to the disclosure. The light engine 450 includes an LED circuit board 400. The LED circuit board 400 includes a plurality of LEDs 404 mounted on a substrate 402. The LED circuit board 400 also includes an electrical connector 408, configured to power the LEDs 404 and to transmit and receive data. Also mounted on substrate 402 is electronic circuitry 406, which includes a non-volatile memory, and logic components. In various embodiments, the electronic circuitry 406 is powered by the electrical connector 408, by other connection to the luminaire 12, or by direct connection to an external power source when not installed in a luminaire. The control system 200, described with reference to FIG. 2, is suitable for use as the electronic circuitry 406 in some embodiments. In some embodiments, the LED circuit board 400 includes an NFC module 432 that is electrically coupled to the electronic circuitry 406. NFC is a standard protocol for short-range, low-power wireless communication and may be supported in devices such as cellular phones.

The light engine 450 further includes optical devices 414, configured to receive a light beam 412*a* emitted by LEDs 404, and to emit a modified light beam 412*b*. In some embodiments, the optical devices 414 include a collimation and homogenization system, as well as optical systems such as gobos, prisms, irises, color mixing systems, framing shutters, variable focus lens systems, and other optical devices suitable for use in theatrical luminaires. In embodiments where the optical system is a projection optical system, the modified light beam 412*b* passes through a projection lens system 416 before exiting the luminaire.

In some embodiments, the controller 200 may position a light sensor 418 within the modified light beam 412*b* (at position 418*a*) or outside the modified light beam 412*b* (at position 418*b*) to allow the light output from LEDs 404 to be measured (when in position 418*a*). In other embodiments, the light sensor 418 may be positioned in the light beam 412*a*, rather than in the light beam 412*b*.

In some embodiments, the light sensor 418 receives light emitted by all the LEDs 404. In other embodiments, the light sensor 418 receives light emitted by a subset of the LEDs 404 (as discussed in more detail with reference to FIG. 5). In still other embodiments, the light sensor 418 receives light emitted by a plurality of the LEDs 404 within a concentric zone (as discussed in more detail with reference to FIG. 14). In some embodiments, the light sensor 418 is configured to measure only a light level. In other embodiments, the light sensor 418 is configured to measure light level and spectral color information.

In some embodiments, the light sensor 418 is mounted on a mechanism such as an arm or a wheel that is configured to move the light sensor 418 into and out of the light beam 412*b*. In other embodiments, the light sensor 418 is mounted to one of the optical devices 414, such as a prism, and configured so that when the one of the optical devices 414 is inserted into the light beam 412*a*, the light sensor 418 is also moved into the light beam 412*a*.

In some embodiments, the light sensor 418 is electrically and communicatively connected to the control system 200 of the luminaire 12. In other embodiments, the light sensor 418 is electrically and communicatively connected to the electronic circuitry 406 of the LED circuit board 400.

Figure 5:
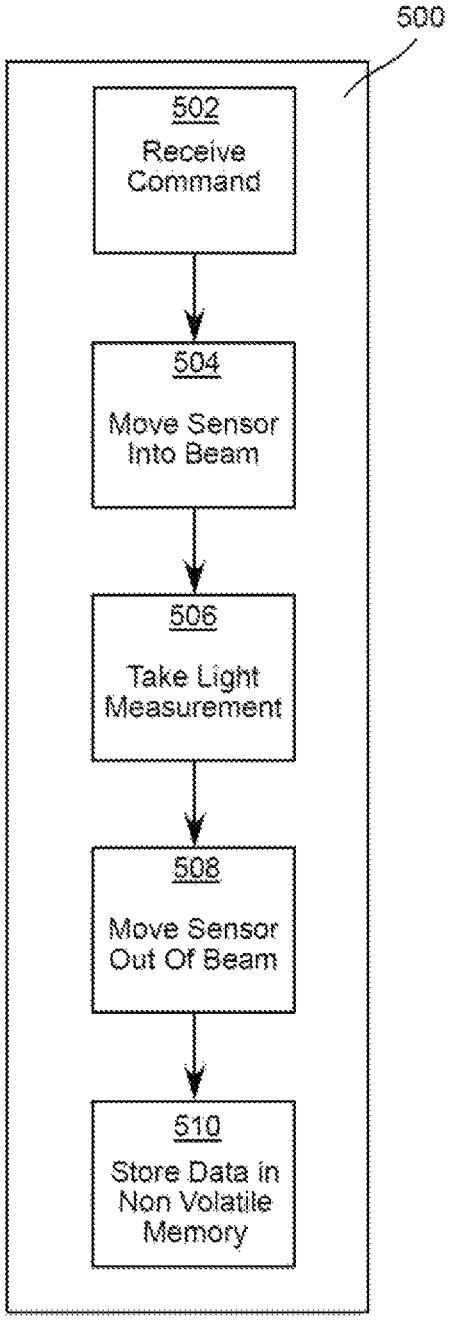
FIG. 5 presents a flow chart of a light measurement process according to the disclosure.

FIG. 5 presents a flow chart of a light measurement process 500 according to the disclosure. The light measurement process 500 is performed while the LED circuit board 400 is installed and in use in the luminaire 12. The light measurement process 500 may be performed by either the control system 200 of the luminaire 12 or by the electronic circuitry 406 of the LED circuit board 400 via the control system 200. In step 502, the processor 202 receives a command directly or indirectly via the data link 14, where the command instructs the luminaire 12 to perform a light level reading. In step 504, the processor 202 reacts to the command by moving the light sensor 418 into the position 418*a* in the modified light beam 412*b* via control interface 208, as described with reference to FIGS. 2 and 4. Once the light sensor 418 is in the position 418*a*, in step 506 the processor 202 takes a light level measurement. In step 508, once the processor 202 has received a signal from light sensor 418 relating to an intensity of the modified light beam 412*b*, the processor 202 moves the light sensor 418 to position 418*b*, out of the modified light beam 412*b*. Finally, in step 510 the processor 202 stores a light level reading in the non-volatile memory of the electronic circuitry 406 of the LED circuit board 400, the light level reading including the data corresponding to the light level measurement received from the light sensor 418. With such a light level reading stored on the LED circuit board 400, when a user moves an LED circuit board 400 from one luminaire to another, or replaces one LED circuit board 400 with another LED circuit board 400, the most recent light level reading of each LED circuit board 400 remains with the LED circuit board 400.

In embodiments that include LED packages with multiple colors of LED dies, step 506 may include taking multiple measurements. In such embodiments, the processor 202 powers LEDs of each color in turn, taking a light level measurement of each color subset of the LED dies. In step 510 of such embodiments, the processor 202 stores the light level reading and a subset (color) identifier for the measured subset in the non-volatile memory of the electronic circuitry 406 of the LED circuit board 400. LEDs of different colors may lose output at differing rates and such embodiments allow the user to track those differing changes between colors.

Similarly, in embodiments that include two or more pluralities of LEDs within concentric zones (as discussed in more detail with reference to FIG. 14), step 506 may include taking multiple measurements. In such embodiments, the processor 202 powers LEDs of each zone in turn, taking a light level measurement of each zone. In step 510 of such embodiments, the processor 202 stores the light level reading and an identifier for the measured zone in the non-volatile memory of the electronic circuitry 406 of the LED circuit board 400. Usage patterns of LEDs in different zones may differ, causing the LEDs of one zone to lose output at a different rate than the LEDs of another zone and such embodiments allow the user to track those differing changes between zones.

In some embodiments, the electronic circuitry 406 of the LED circuit board 400 is configured to store a plurality of light level readings over time, creating a light level history of the LEDs 404 (or subsets of differently colored LEDs). In some such embodiments, the order in which the light level readings are stored is reflected in a memory address at which each light level reading is stored—for example, later readings may be stored at higher memory addresses than earlier readings. In other such embodiments, the electronic circuitry 406 assigns an increasing sequence number to each light level reading as it is stored. In still other such embodiments, the controller 200 includes a clock (or communicates with an external clock) and determines a time at which the data corresponding to the light level measurement was obtained. In such embodiments, the light level reading stored in the non-volatile memory of the electronic circuitry 406 also includes data relating to the determined time (e.g., a timestamp). In some such embodiments, the determined time includes both a calendar date and a time of day.

Storing current light level readings on the LED circuit board 400 has a number of benefits for the user. As the LEDs 404 age, their light output reduces. When current light level readings are stored on LED circuit boards 400, the user can adjust light levels emitted by the LED circuit boards 400 or their associated luminaires 12 so that luminaires 12 used together more closely match each other in brightness.

Furthermore, when a light level history is stored on the LED circuit board 400, the user can predict future light levels (for example, using a time series regression) so that when a system of luminaires 12 is used on a long-running show (such as a Broadway production or in a theme park), the user can predict when individual LED circuit boards 400 will need to be replaced.

The stored light level reading data may be read out from the non-volatile memory through the processor 202 and data link 14, or via the NFC module 432. In embodiments storing the light level history, the electronic circuitry 406 of the LED circuit board 400 may be configured to selectively read out either the most recent stored light level reading or the entire light level history.

In further embodiments the non-volatile memory of the electronic circuitry 406 on the LED circuit board 400 may also be used to store data relating to the LED circuit board 400, including, but not limited to, serial number (in any format) of the LED circuit board 400; usage history; power level history; command history; serial numbers of luminaires 12 into which the LED circuit board 400 has been installed; date (which may include both a calendar date and a time of day) on which the LED circuit board 400 was installed, working hours, and last light level reading in the present luminaire 12 and/or into previous luminaires 12 (identified by luminaire serial number); expected reduction in light output from LEDs based on working hours, intensity levels the LEDs were working, and latest (or historical) light level reading(s); and other data about the LED circuit board 400 that could be useful to the user.

As shown in FIG. 2, in yet further embodiments, the data on the LED circuit board 400 may be accessed by an external NFC transceiver 214 such as a cellular phone or smartphone via the NFC module 432 using a radio frequency link 222. This would allow the user or (in the case of a rented product) the product owner, to quickly extract historical usage and/or operational data from an LED circuit board 400 without having to make a direct electrical connection. The NFC transceiver 214 may be configured to read data from the non-volatile memory of the electronic circuitry 406 while the LED circuit board 400 is removed for maintenance or while a luminaire in which it is installed is not coupled to an external power source.

In other embodiments, some or all of the stored data relating to the LED circuit board 400 may be obtained from the electronic circuitry 406 by the processor 202 and stored in the memory 204. Not only stored data relating to the LED circuit board 400 currently installed in the luminaire 12 may be stored in the memory 204, but also data relating to LED circuit boards 400 previously installed in the luminaire 12. Such data may include, for each such previous LED circuit board 400, a serial number, and a date and/or time that the LED circuit board 400 was installed in the luminaire 12.

Such data stored in the memory 204 may be transmitted to one or more control desks 15 via the communication interface 206 and the data link 14 or displayed on a display accessible to a user on an exterior surface of the luminaire 12. Such data may additionally or alternatively be obtained by the external NFC transceiver 214 via the NFC module 210 using a radio frequency link 220. Use of the NFC module 210 may be beneficial when wireless communications with the NFC module 432 is blocked once the LED circuit board 400 is installed in the luminaire 12. The NFC module 210 may be configured to access memory 204 while the luminaire 12 is not coupled to an external power source. A location for the NFC module 210 within the luminaire 12 may be selected to enable wireless communication while the luminaire 12 is installed for operation or while it is stowed for transportation.

Figure 6A:
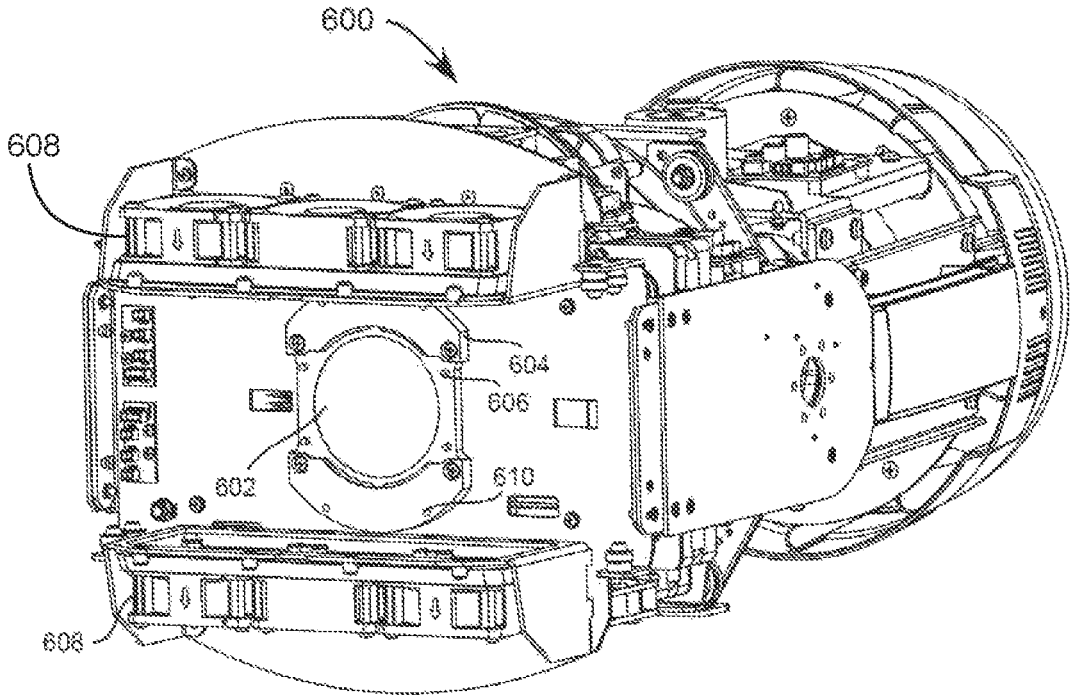
FIG. 6A presents an orthogonal rear view of a luminaire without an LED circuit board installed.
Figure 6B:
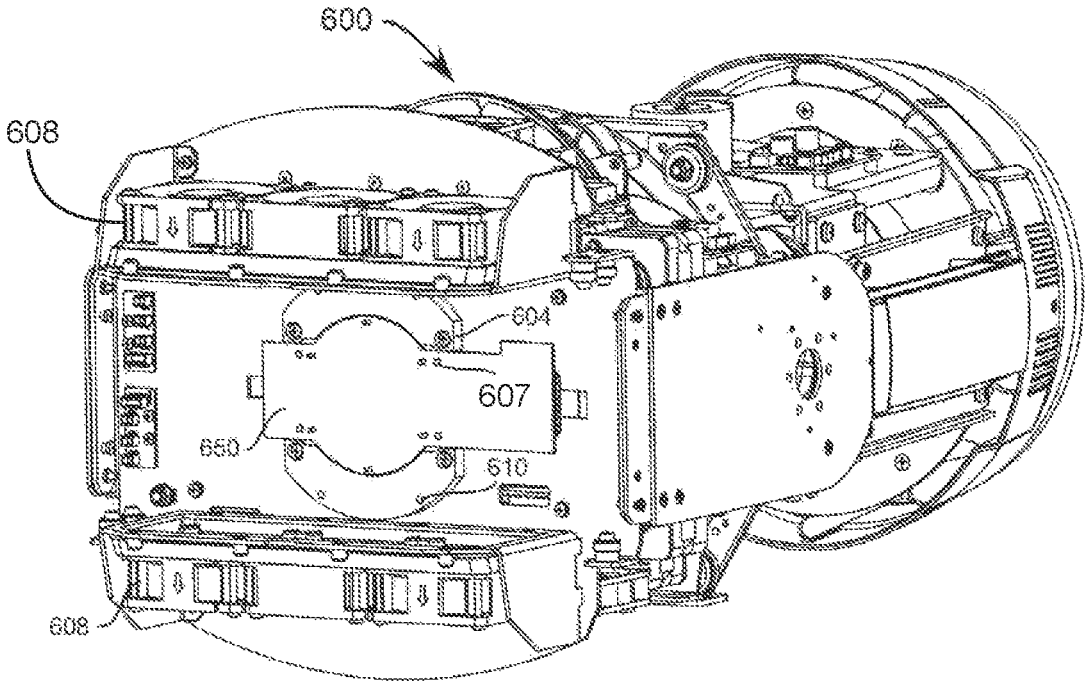
FIG. 6B presents an orthogonal rear view of a luminaire with an LED circuit board installed.

FIGS. 6A and 6B present an orthogonal rear view of a luminaire 600 without and with an LED circuit board 650 installed, respectively. The chassis of the luminaire 600 includes an LED module mounting plate 604 that surrounds an aperture 602. The chassis also includes cooling fans 608. The lenses and other optical systems of the luminaire optical system are mounted within the chassis of the luminaire 600 and remain in the luminaire 600 when the user replaces the LED circuit board 650. While the luminaire 600 is shown with all outer covers removed for clarity, in some embodiments only a back cover needs to be removed for the user to remove and replace the LED circuit board 650 (or the LED module 700, described below with reference to FIG. 7).

The LED module mounting plate 604 includes mounting features to accurately align the LEDs of the LED circuit board 650 with the body of the luminaire and internal optics. Alignment pins 606 protrude from the LED module mounting plate 604 and mate with registration holes 607 in the LED circuit board 650 to align it with the LED module mounting plate 604. The LED module mounting plate 604 has threaded holes 610 that accept screws from the LED circuit board 650 to affix the LED circuit board 650 to the LED module mounting plate 604. In FIG. 6B, an LED circuit board 650 is shown in place with the alignment pins 606 in the registration holes 607 in the LED circuit board 650, thereby accurately positioning the LEDs of the LED circuit board 650 with the optical systems in the luminaire 600.

Figure 7:
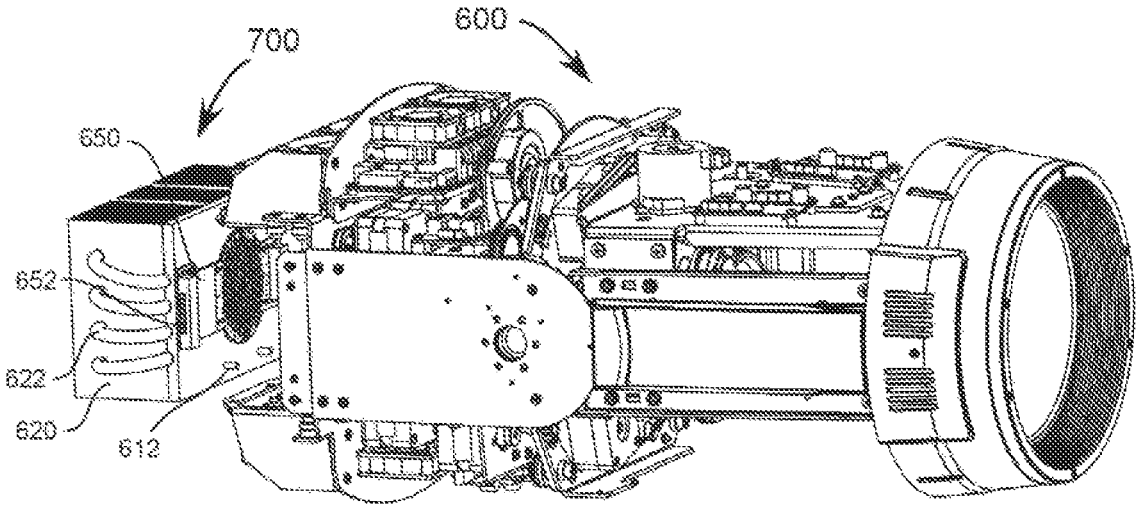
FIG. 7 presents an orthogonal side view of the luminaire of FIGS. 6A and 6B, and an LED module according to the disclosure.

FIG. 7 presents an orthogonal side view of the luminaire 600 of FIGS. 6A and 6B, and an LED module 700 according to the disclosure. The LED module 700 is shown in the process of being attached to the rear of the luminaire 600. The LED module 700 comprises the LED circuit board 650 mounted to a heat sink 620. The heat sink 620 includes heat pipes 622 configured to transfer heat from a portion of the heat sink 620 adjacent to the LED circuit board 650 to another portion of the heat sink 620. The heat sink 620 is configured to receive cooler air from one set of the cooling fans 608 and to have heated air removed by the other set of the cooling fans 608.

While the cooling fans 608 are attached to the chassis of the luminaire 600, in other embodiments, the LED module 700 includes cooling fans that are installed and removed from the luminaire 600 along with the LED circuit board 650 and the heat sink 620.

The LED circuit board 650 includes electrical connector 652 configured to provide electrical coupling to the electrical power and control systems of the luminaire 12 as previously described. In some embodiments, the LED circuit board 650 also includes electronic circuitry 406, as described with reference to FIG. 4. The LED module 700 is configured to mechanically couple to the chassis of the luminaire 600 by screws 612, which connect to the threaded holes 610 shown in FIGS. 6A and 6B. In some embodiments, the screws 612 are captive screws. In other embodiments, the LED module 700 mechanically couples to the chassis of the luminaire 600 by another suitable fastener that can be engaged and disengaged, for example, a quarter-turn fastener.

Figure 8:
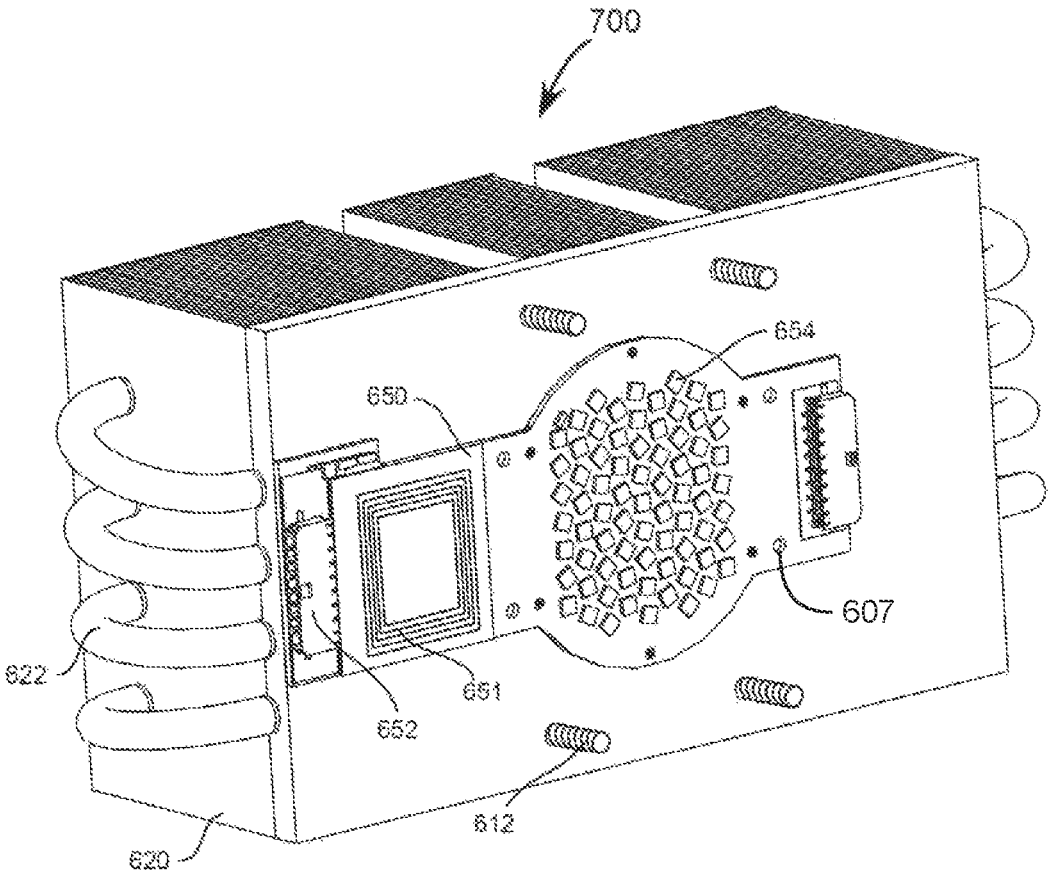
FIG. 8 presents an orthogonal view of the LED module of FIG. 7.

FIG. 8 presents an orthogonal view of the LED module 700 of FIG. 7. The LED circuit board 650 includes LEDs 654 and is in thermal contact with the heat sink 620. The LEDs 654 all emit white light. In other embodiments, the LEDs 654 are LED packages with multiple colors of LED dies inside. In some such embodiments, the LEDs 654 may include red, green, blue, and white dies. In other such embodiments, other or additional colors may be included, such as lime, amber, indigo, and other colors.

Accurate alignment of the LED module 700 is provided by alignment pins 606 (shown in FIG. 6A) which protrude from the LED module mounting plate 604 (or other portion of the chassis of the luminaire 600) and mate with matching registration holes 607 (one of which is indicated in FIG. 8) in LED circuit board 650. In some embodiments, the LED circuit board 650 includes NFC circuitry and an NFC antenna 651. The NFC antenna 651 is positioned and configured to be accessed by an NFC transceiver outside the luminaire without having to dismantle the luminaire.

Figure 9:
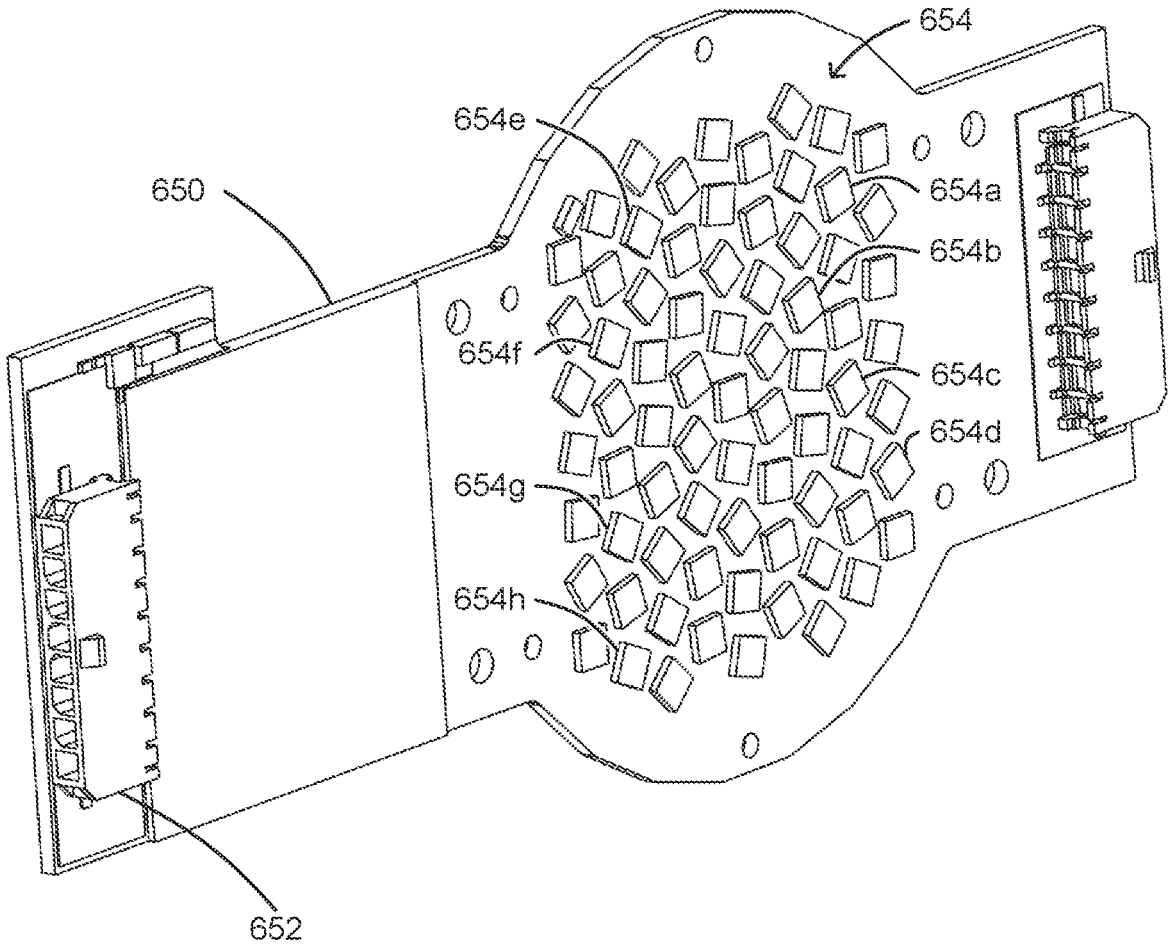
FIG. 9 presents an orthogonal view of the LED circuit board of FIGS. 6A, 6B, and 7.

FIG. 9 presents an orthogonal view of the LED circuit board 650 of FIGS. 6A, 6B, and 7. LEDs 654 are mounted to the LED circuit board 650 in an array and are rotated with respect to each other along an axis perpendicular to the plane of the LED circuit board 650. This rotation of the LEDs 654 relative to each other improves homogenization of the light output from the LEDs 654.

A first plurality of LEDs includes LEDs 654*a*, 654*b*, 654*c*, and 654*d*, which are not rotated relative to each other. A second plurality of LEDs includes LEDs 654*e*, 654*f*, 654*g*, and 654*h*, which also are not rotated relative to each other. However, the LEDs of the first plurality of LEDs are rotated relative to the LEDs of the second plurality of LEDs. While only two pluralities of commonly-rotated LEDs are identified, it can be seen in FIG. 9 that additional pluralities of commonly-rotated LEDs are present on the LED circuit board 650.

LED dies are typically square, as is shown in FIG. 9, or otherwise rectangular. By rotating the LED dies of each plurality of LEDs relative to the other pluralities of LEDs by an amount that is not an integer multiple of 90° (90 degrees), the LED circuit board 650 produces a more rounded or circular beam, reducing the effect on the beam shape of the flat sides of the rectangular dies. By including pluralities of LEDs with a common rotation amount (rather than each LED of the LED circuit board 650 being individually rotated relative to all the other LEDs), the process of designing the LED circuit board 650 is simplified and its manufacturing process is made simpler and less costly.

In order to replace LED module 700, the user first removes a rear cover (or other access panel) from a housing of the luminaire to gain access to the LED module 700. In some embodiments, the access panel remains tethered to the luminaire once removed from the luminaire. Via the access aperture, the user electrically uncouples the LED circuit board 650 by disconnecting the electrical connector 652 from the electrical power and control systems of the luminaire 12, removes the screws 612 to mechanically uncouple the LED module 700 from the luminaire 12, and removes the LED module 700 through the access aperture. A new LED module 700 can then be installed in the luminaire 12 by reversing the steps of the removal process. In a further embodiment, the cost of replacing the LED circuit board 650 in the luminaire 12 is further reduced by replacing the LED circuit board 650 on the removed LED module 700 and re-installing the LED module 700, re-using the heat sink 620.

In some embodiments, the LED module 700 is mechanically coupled to the rear cover or access panel, and removing the cover or panel mechanically uncouples the LED module 700 from the luminaire 12.

Replacement of the LED module 700 requires only enough disassembly of the luminaire 12 to access and physically remove the LED module 700. As the LED module 700 contains only the LED circuit board 650 and heat sink 620, the cost of replacement is significantly reduced over replacing an LED optical system that includes some or all of the other optical elements of the LED optical system 300 described with reference to FIG. 3. In some embodiments, all optical elements and LED lenses remain in the luminaire 12 and do not get replaced. In other embodiments, one or both of lens arrays 308 and 312 are part of the LED module 700.

The alignment pins 606 and matching registration holes 607 in LED circuit board 650 provide alignment structures that ensure accurate alignment of the LEDs with their associated optics. However, the disclosure is not so limited and in other embodiments other alignment methods may be used without departing from the spirit of the disclosure. For example, in other embodiments other numbers and shapes of alignment pins and matching registration holes could be used, as could tabs and slots, or other mechanical alignment structures comprising alignment protrusions and corresponding registration receptacles configured to ensure that no optical alignment of the LED module 700 is required, once installed. In all embodiments, the alignment protrusions may be part of the LED circuit board 650 and the registration receptacles part of the LED module mounting plate 604 or other portion of the chassis of the luminaire 600.

Figure 10:
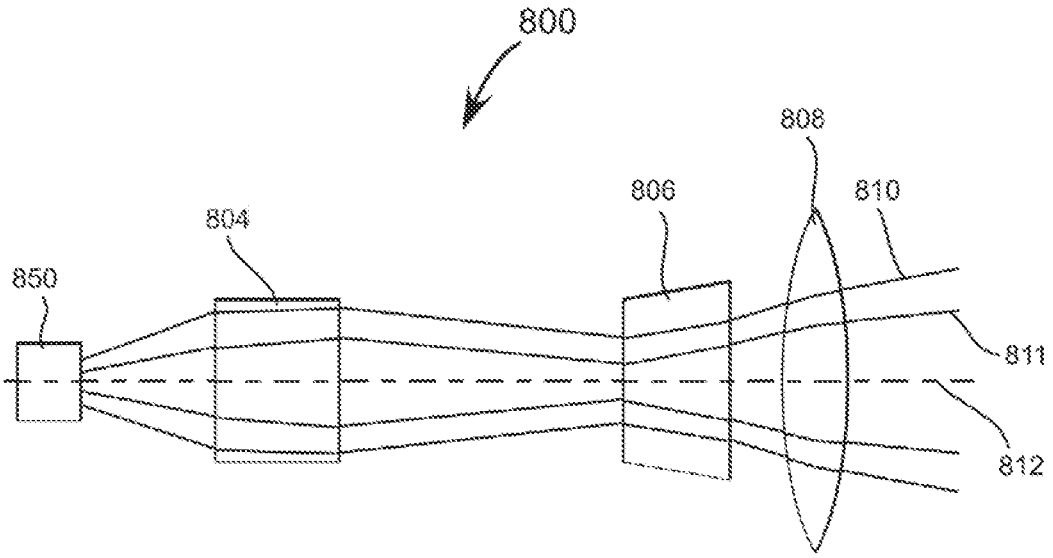
FIGS. 10 and 11 present a ray trace view of a zoom optical system according to the disclosure in respective first and second configurations.
Figure 11:
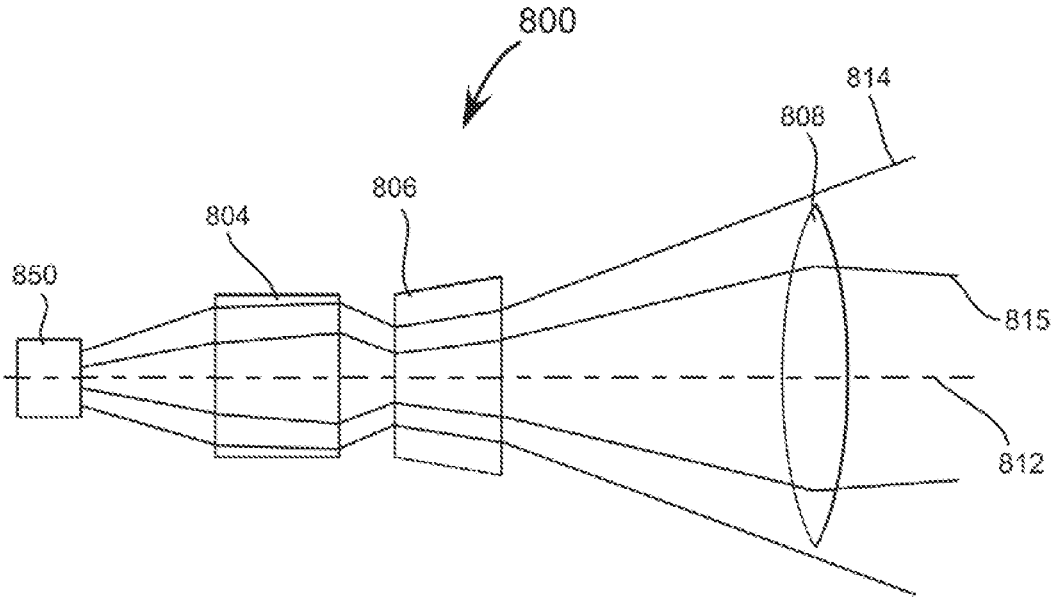

FIGS. 10 and 11 present a ray trace view of a zoom optical system 800 according to the disclosure in respective first and second configurations. The zoom optical system 800 comprises an LED light engine 850 and a three-group zoom lens system that includes lens groups 804, 806, and 808. The LED light engine 850 may be the light engine 300 or 450 as described with reference to FIGS. 3 and 4, respectively, or may be another light engine according to the disclosure. Lens groups 804 and 806 are independently movable in a direction parallel to an optical axis 812 of the zoom optical system 800, enabling an operator to adjust focus and beam angle of a light beam emitted by the zoom optical system 800. The lens group 808 is an output lens group and is fixed in position relative to the LED light engine 850.

While the lens groups 804, 806, and 808 are referred to herein as 'groups,' it will be understood that any or all of the lens groups 804, 806, and 808 may include a single lens or a plurality of lenses. With reference to FIG. 4, in some embodiments the lens groups 804, 806, and 808 are elements of the projection lens system 416. In other embodiments, the lens groups 804 and 806 are elements of the optical devices 414 and the output lens group 808 is an element of the projection lens system 416.

FIG. 10 shows the zoom optical system 800 in a first configuration, where lens groups 804 and 806 are positioned so as to produce a wide-angle output beam. A ray 810 indicates a light beam originating from a periphery of the LED light engine 850 and forming a periphery of the light beam emitted by the zoom optical system 800. The ray 810 may be seen to fall well within the diameter of the output lens group 808. An output ray 811 shows a ray emerging from the LED light engine 850 intermediate between the peripheral ray 810 and the optical axis 812.

FIG. 11 shows the zoom optical system 800 in a second configuration, where lens groups 804 and 806 are positioned so as to produce a narrow-angle output beam. The ray 814 emerging from the periphery of the LED light engine 850 can be seen to fall outside of the diameter of the output lens group 808. This is referred to as vignetting. When the zoom optical system 800 is mounted in a luminaire whose housing encloses the lens group 808, the housing may block the ray 810 and other rays that pass around the outside of the output lens group 808, resulting in a loss of brightness from the luminaire and an increased heat in the luminaire caused by the blocked light. The diameter of the output lens group 808 may be increased, in order to capture the ray 810. However, increasing the diameter of a lens can make it heavier and increase the overall size of the luminaire, which may limit the amount by which the lens diameter can be increased, limiting the amount of the periphery of the beam than can be captured.

Figure 12:
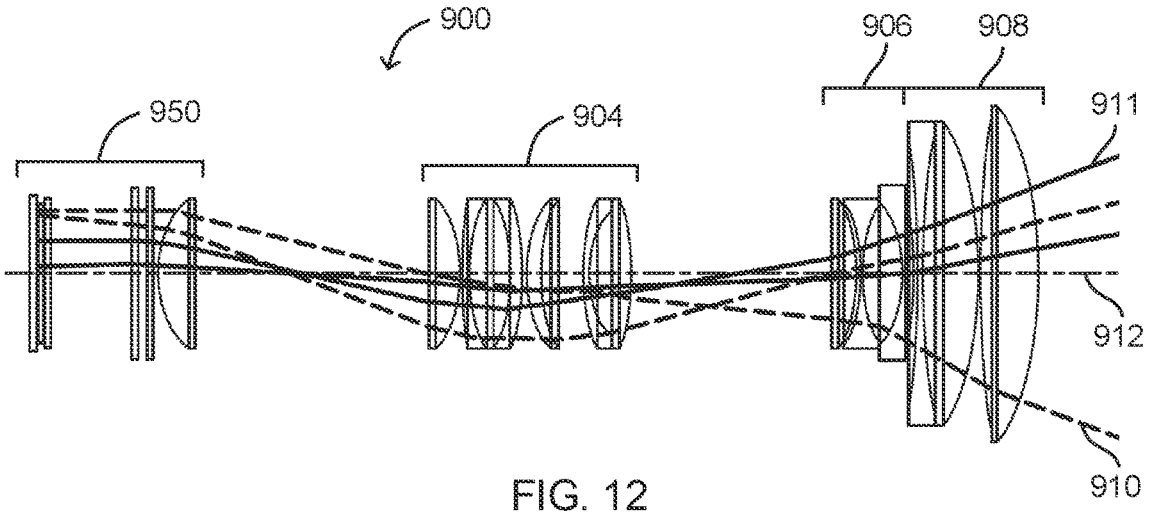
FIGS. 12 and 13 present a ray trace view of a second zoom optical system according to the disclosure in respective first and second configurations.
Figure 13:
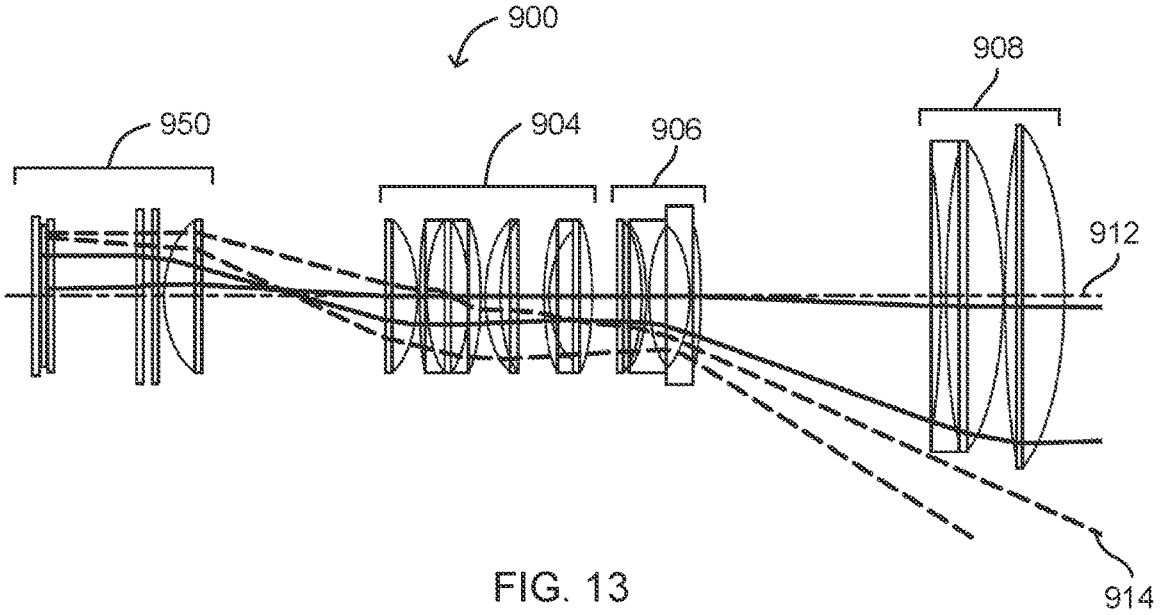

FIGS. 12 and 13 present a ray trace view of a second zoom optical system 900 according to the disclosure in respective first and second configurations. The views in FIGS. 12 and 13 are similar to those in FIGS. 10 and 11, but provide a more complete representation of the optical system 900. The zoom optical system 900 comprises an LED light engine 950 and a three-group zoom lens system that includes lens groups 904, 906, and 908. The LED light engine 950 may be the light engine 300 or 450 as described with reference to FIGS. 3 and 4, respectively, or may be another light engine according to the disclosure. Lens groups 904 and 906 are independently movable in a direction parallel to an optical axis 912 of the zoom optical system 900, enabling an operator to adjust focus and beam angle of a light beam emitted by the zoom optical system 900. The lens group 908 is an output lens group and is fixed in position relative to the LED light engine 950.

FIG. 12 shows the zoom optical system 900 in a first configuration, where lens groups 904 and 906 are positioned so as to produce a wide-angle output beam. A ray 910 indicates a light beam originating from a periphery of the LED light engine 950 and forming a periphery of the light beam emitted by the zoom optical system 900. The ray 910 may be seen to fall well within the diameter of the output lens group 908. An output ray 911 shows a ray emerging from the LED light engine 950 intermediate between the peripheral ray 910 and the optical axis 912.

FIG. 13 shows the zoom optical system 900 in a second configuration, where lens groups 904 and 906 are positioned so as to produce a narrow-angle output beam. A ray 914 originating from a periphery of the LED light engine 950 can be seen to fall outside of the diameter of the output lens group 908. As described with reference to FIG. 11, this vignetting may result in a loss of brightness from the luminaire and an increased heat in the luminaire caused by the blocked light.

Figure 14:
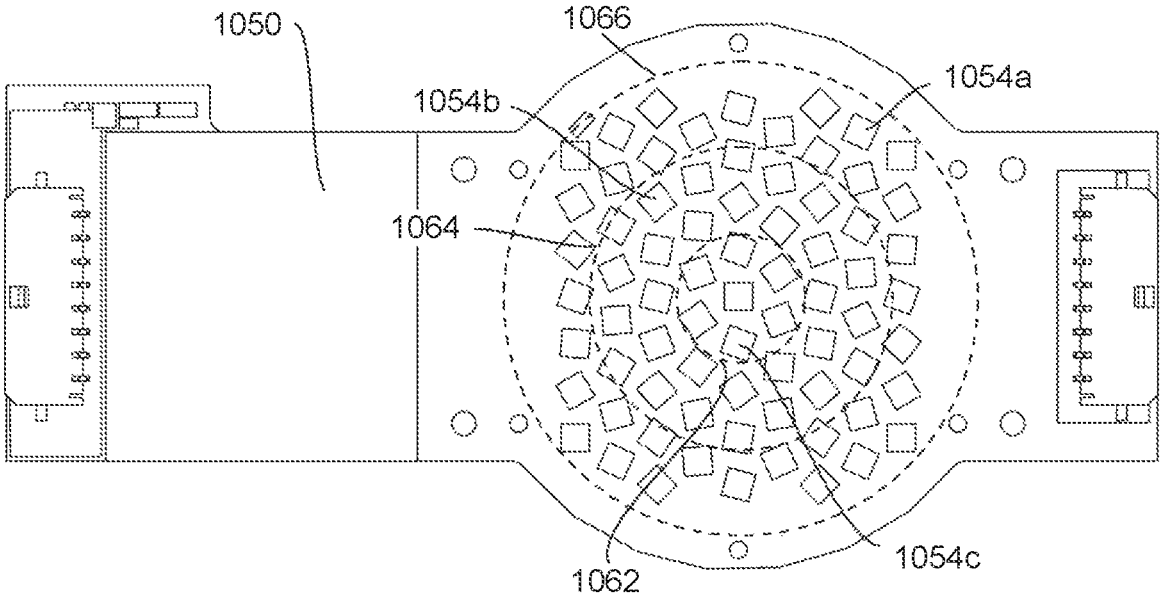
FIG. 14 presents a plan view of a second LED circuit board according to the disclosure.

FIG. 14 presents a plan view of a second LED circuit board 1050 according to the disclosure. The LED circuit board 1050 provides an improved solution to the problem of vignetting described with reference to FIGS. 11 and 13 and is suitable for use in the LED light engines 850 and 950, described with reference to FIGS. 11 and 13. The individual LEDs in the LED circuit board 1050 are electrically connected such that they are controllable in concentric zones, generally indicated by dashed lines 1062, 1064, and 1066. An intensity of an LED 1054*c* and other LEDs of a plurality of LEDs that are within the central zone 1062 are controlled together. An intensity of an LED 1054*b* and other LEDs of a plurality of LEDs that are within the intermediate zone 1064 but outside the central zone 1062 are controlled together. An intensity of an LED 1054*a* and other LEDs of a plurality of LEDs that are within the outer zone 1066 but outside the intermediate zone 1064 are controlled together.

While the following comments describe features of the LED circuit board in the context of FIGS. 10 and 11, it will be understood that the comments also apply to the use of the LED circuit board 1050 in the zoom optical system 900 of FIGS. 12 and 13. When the zoom optical system 800 is moved to the narrow angle beam configuration shown in FIG. 11, the control system 200 responds by reducing the power applied to LEDs in the outer zone 1066 and increasing power to the LEDs in the intermediate zone 1064 and center zone 1062. This reduces the light loss caused by vignetting as illustrated in FIG. 11 by providing more brightness from the LEDs that comprise the non-vignetted portions of the light beam. In other embodiments, the zoom optical system 800 may produce a still narrower angle beam configuration, and power applied to the LEDs in both the outer zone 1066 and the intermediate zone 1064 is reduced and power to the LEDs in the center zone 1062 may be increased.

In some embodiments, higher power LEDs (i.e., LEDs capable of handling higher drive current) are provided in the center zone 1062 (and in some such embodiments in the intermediate zone 1064, as well). In such embodiments, if a brighter beam from the luminaire 12 is desired by an operator when the optical system is zoomed to a narrow beam angle, power to the higher power LEDs in the center zone 1062 (and the intermediate zone 1064) may be increased to produce a significantly brighter beam. If the operator desires the beam brightness to remain constant as the optical system zooms from a wider beam to a narrower beam, power to the LEDs in the center zone 1062 and the intermediate zone 1064 may be controlled to produce the desired constant beam brightness.

In some embodiments, when the zoom optical system 800 is in the narrow angle beam configuration shown in FIG. 11, the control system 200 applies no power to the LEDs in the outer zone 1066. In some such embodiments, when the zoom optical system 800 is in an intermediate configuration between the wide angle of FIG. 10 and the narrow angle of FIG. 11, the control system 200 applies a reduced power to the LEDs in the outer zone 1066.

In some embodiments, the LED circuit board 1050 includes electronic circuitry 406, as described with reference to FIG. 4, and it is the electronic circuitry 406 that reduces power to, switches off, and/or increases power to LEDs in the zones 1062, 1064, and 1066. In such embodiments, the electronic circuitry 406 is configured to receive a control signal from the control system 200 or from another device external to the LED circuit board 1050, the signal relating to a beam angle configuration of the zoom optical system 800. In response to the received signal, the electronic circuitry 406 determines what changes (if any) to make to the power allocated to the zones 1062, 1064, and 1066, which zones to change power allocation to, and in what amounts to change that power. In such embodiments, power transistors for the LEDs may be located either in the LED module (e.g., LED module 700, described with reference to FIGS. 7 and 8) or in the luminaire 12.

In some embodiments, the overall total power provided to the LEDs is kept constant, but the ratio of power to each zone is changed, according to a desired zoom angle. As described in more detail with reference to FIG. 15, in some embodiments, more or fewer than three LED zones may be provided. Regarding the concentric zones 1062, 1064, and 1066, the LEDs that are considered within a zone (and therefore have their intensities jointly controlled) may be located either entirely or partially within the dashed lines. The overall total power can be decreased, without decreasing light output by dimming or switching off vignetted LED zones. This also reduces heat produced inside of the luminaire 12, reducing the heat load on electronics and plastic components within the luminaire 12.

While the LED circuit board 1050 has been described as used with the zoom optical system 800, in other embodiments the LED circuit board 1050 may be used with other adjustable optical elements. For example, in some embodiments the power provided to the zones may be based on an aperture size of a beam-size iris, an adjustment of framing shutters, a selected gobo, or other configuration of one or more adjustable optical elements.

In some embodiments, the power provided to each zone may be based on a control signal received at the controller 200 from a control desk 15 or other external source. In some such embodiments, the power provided to the zones may be based on a configuration of adjustable optical elements unless it is overridden by a control signal received at the controller 200 from an external source.

The adjustable zones of the LED circuit board 1050 provide other benefits. Better output brightness is provided when the zoom optical system 800 is producing a narrow beam without increasing total power, or the same output brightness is provided with lower total power. Better reliability of the luminaire 12 is obtained due to an increased lifetime of luminaire components, electronics, and LEDs resulting from the reduced heat load described above. Such a result is particularly beneficial in sealed luminaires. In some embodiments, LEDs capable of higher possible currents can be used for central zones to provide bigger difference between our and standard solution.

Figure 15:
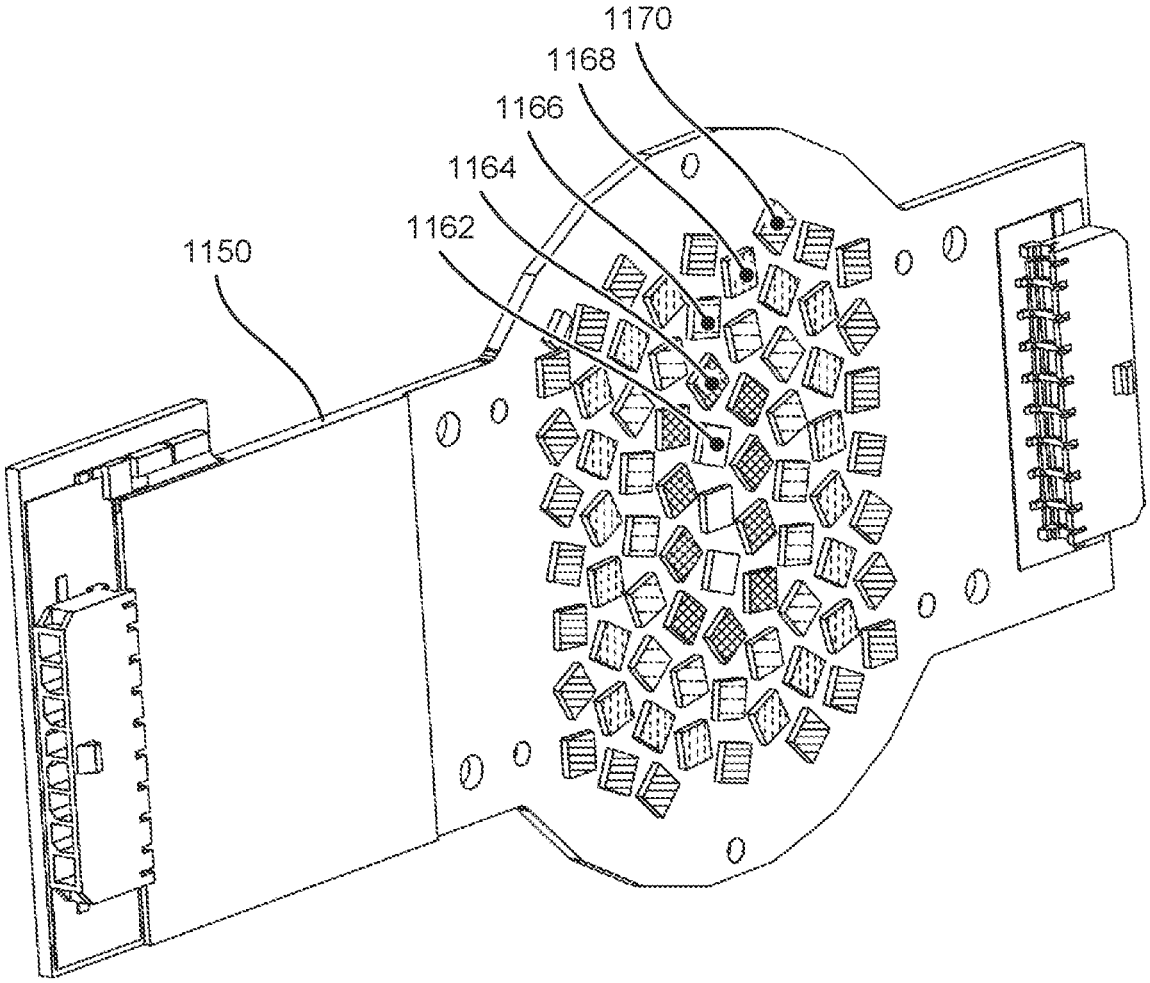
FIG. 15 presents an oblique view of a third LED circuit board according to the disclosure.

FIG. 15 presents an oblique view of a third LED circuit board 1150 according to the disclosure. The LED circuit board 1150 has five concentric zones 1162, 1164, 1166, 1168, and 1170. The LEDs within each zone are indicated by five different cross-hatch patterns. The central zone 1162 is surrounded by successively larger concentric zones 1164, 1166, and 1168, all of which are surrounded by the outer zone 1170. As for the LED circuit board 1050, the intensity of the LEDs in each zone of the LED circuit board 1150 are controlled together, and each zone may be controlled independent of the other zones.

While the LED circuit boards 301, 400, 650, and 850 have been described herein as used with different optical systems and luminaires, it will be understood that each may be used in combination with the other described optical systems and with other, undescribed optical systems.

While the disclosure has been described with respect to a limited number of embodiments, those skilled in the art, having benefit of this disclosure, will appreciate that other embodiments may be devised which do not depart from the scope of the disclosure herein. While the disclosure has been described in detail, it should be understood that various changes, substitutions and alterations can be made hereto without departing from the spirit and scope of the disclosure.

What is claimed is:

1. A method for removing a light-emitting diode (LED) module from a luminaire comprising a housing enclosing an optical system that includes the LED module and other optical devices, the method comprising:

receiving by electronic circuitry of an LED circuit board of the LED module a light level reading including data relating to a measurement of light output produced by an array of LEDs of the LED circuit board;

storing by the electronic circuitry the light level reading in non-volatile memory of the electronic circuitry;

sending by the LED circuit board the stored light level reading via a Near Field Communication (NFC) module of the LED circuit board to an external NFC transceiver;

electrically uncoupling the LED circuit board from the luminaire; and mechanically uncoupling the LED module from the luminaire without removing other optical devices of the optical system from the housing.

2. The method of claim 1, wherein:

one of the LED circuit board and the luminaire further comprises registration receptacles configured to receive alignment protrusions of the other one of the LED circuit board and the luminaire, the alignment protrusions and the registration receptacles configured to optically align the LED circuit board with the optical system, and mechanically uncoupling the LED module from the luminaire comprises removing the alignment protrusions from the registration receptacles.

3. The method of claim 1, wherein mechanically uncoupling the LED module from the luminaire comprises removing screws that mechanically couple the LED module to the luminaire.

4. The method of claim 1, further comprising reading data by the NFC module from the non-volatile memory of the electronic circuitry when the LED circuit board is electrically uncoupled from the luminaire or the luminaire is not coupled to an external power source.

5. The method of claim 1, further comprising storing by the electronic circuitry a second light level reading in the non-volatile memory.

6. The method of claim 5, further comprising selectively reading by the electronic circuitry either the second light level reading or both the first and second light level readings.

7. A method for removing a light-emitting diode (LED) module from a luminaire comprising a controller and housing enclosing an optical system that includes the LED module and other optical devices, the method comprising:

receiving by electronic circuitry of an LED circuit board of the LED module from the controller a light level reading including data relating to a measurement of light output produced by an array of LEDs of the LED circuit board;

storing by the electronic circuitry the light level reading in non-volatile memory of the electronic circuitry;

sending by the LED circuit board the stored light level reading via a Near Field Communication (NFC) module of the LED circuit board to an external NFC transceiver;

electrically uncoupling the LED circuit board from the controller; and mechanically uncoupling the LED module from the luminaire without removing other optical devices of the optical system from the housing.

8. The method of claim 7, wherein:

one of the LED circuit board and the luminaire further comprises registration receptacles configured to receive alignment protrusions of the other one of the LED circuit board and the luminaire, the alignment protrusions and the registration receptacles configured to optically align the LED circuit board with the optical system, and mechanically uncoupling the LED module from the luminaire comprises removing the alignment protrusions from the registration receptacles.

9. The method of claim 7, wherein mechanically uncoupling the LED module from the luminaire comprises removing screws that mechanically couple the LED module to the luminaire.

10. The method of claim 7, further comprising:

obtaining by the controller a measurement relating to light output produced by the array of LEDs; and storing by the electronic circuitry in non-volatile memory of the electronic circuitry data relating to the measurement as the light level reading.

11. The method of claim 10, further comprising:

receiving by the controller a command to perform a light level reading; and in response to receiving the command, performing the steps of:

obtaining the measurement relating to light output; and storing the data relating to the measurement.

12. The method of claim 10, wherein the array of LEDs includes a subset of LEDs emitting light of a common color, the method further comprising:

prior to obtaining the measurement relating to light output, applying power by the controller to only the subset of LEDs; and storing by the electronic circuitry, as part of the data relating to the measurement, data identifying the subset of LEDs.

13. The method of claim 10, further comprising:

prior to obtaining the measurement relating to light output, positioning by the controller a light sensor in a light beam produced by the array of LEDs; and obtaining by the controller from the light sensor the measurement relating to light output.

14. The method of claim 13, further comprising:

receiving by the controller a command to perform a light level reading; and in response to receiving the command, performing the steps of:

positioning the light sensor in the light beam;

obtaining the measurement relating to light output; and storing the data relating to the measurement.

15. The method of claim 10, further comprising storing by the electronic circuitry, as part of the data relating to the measurement, data relating to a time the measurement was obtained.

16. The method of claim 10, further comprising:

obtaining by the controller a second measurement relating to light output produced by the array of LEDs; and storing by the electronic circuitry in the non-volatile memory of the electronic circuitry data relating to the second measurement as a second light level reading.

17. The method of claim 16, further comprising selectively reading by the controller from the electronic circuitry either the second light level reading or both the first and second light level readings.

* * * * *